United States Patent [19]

Childers

[11] Patent Number: 4,843,836

[45] Date of Patent: Jul. 4, 1989

[54] BEVERAGE CHILLER AND METHOD THEREFORE

[76] Inventor: Todd A. Childers, 345 E. Glenn, Tucson, Ariz. 85701

[21] Appl. No.: 232,762

[22] Filed: Aug. 16, 1988

[51] Int. Cl.[4] ..... F25D 3/00

[52] U.S. Cl. ..... 62/293; 62/457.4

[58] Field of Search ..... 62/457, 459, 371, 372, 62/293, 330

[56] References Cited

U.S. PATENT DOCUMENTS

| | | | |
|---|---|---|---|
| 91,021 | 6/1869 | Howarth | 62/457 X |
| 160,438 | 3/1875 | Jones | 62/457 |
| 1,471,449 | 10/1923 | Cahill | 62/457 |
| 2,016,514 | 10/1935 | Putnam | 62/293 |
| 2,144,177 | 1/1939 | Blomquist | 62/457 |
| 2,805,554 | 9/1957 | Schachtsiek | 62/293 X |
| 3,359,756 | 12/1967 | Mirquet | 62/457 |

FOREIGN PATENT DOCUMENTS

| | | | |
|---|---|---|---|
| 234237 | 5/1925 | United Kingdom | 62/457 |

*Primary Examiner*—Lloyd L. King
*Attorney, Agent, or Firm*—Harry M. Weiss

[57] ABSTRACT

This is an improved beverage chiller which comprises a metallic preferably cylindrical shaped container preferably having a beveled mouth opening, a handle near the bottom end of the mouth opening, and a hook opposite to the handle as shown in the drawings. The container of the chiller is filled with fresh ice when its use is needed and it can be hung directly in the beverage fluid located in the container by means of its handle. This invention provides a "beverage chiller" without affecting the quality of the beverage itself, i.e., avoids dilution of the beverage from the melting ice that is placed directly into the beverage in conventional applications where beverage chilling is desired.

8 Claims, 2 Drawing Sheets

BEVERAGE CHILLER AND METHOD THEREFORE

BACKGROUND OF THE INVENTION

1. Field of the Invention

This invention relates generally to an improved type of beverage chiller and method therefore, and, more specifically, to an improved beverage chiller and method therefore that can be rapidly coupled to or decoupled from a beverage container in a manner that isolates the cooling medium, generally ice, from the beverage itself thus preserving the integrity of the quality of the fluid while at the same time accomplishing the chilling of the beverage.

2. Description of the Prior Art

In the past, the preference for comsumption of most beverages was while the beverage remained cold and, it was generally the custom, in order to accomplish this, that people would usually deposit ice cubes in their beverage. The ice was scooped into the beverage container and readily placed inside the container containing the beverage at the bottom portion of this container. The problems with this practice are many, the ice cools the beverage by absorbing the heat at the same time that it melts changing from a solid to a liquid phase, thus diluting the beverage. This diluted portion tends to remain near the top of the fluid while the undiluted portion sinks to the bottom, thus changing the flavor of the beverage as well as affecting the quality or consistency of the drink from top to bottom.

This problem of chilling a beverage directly with ice which diluted the beverage is not new, has been with us for some time and until this invention there has not had a satisfactory solution thereof. A solution to this problem is especially needed in a commercial beverage dispensing type setting where it is desirable to preserve the integrity of the flavor and composition of the beverage as well as being able to reuse the same chilling medium as soon as possible.

U.S. Pat. No. 4,554,189 issued in 1985 to Marshall used a plastic container which had a phase-change medium, such as water that had to be frozen in the container prior to placing the container in a beverage and, as it consumed heat from the beverage, the phase-change medium liquified but it remained confined to the container. The key disadvantage with this prior art beverage chiller device was that before it could be used again it needed to be frozen to form ice within the container The re-freezing process was slow and time consuming and therefore a problem for commercial settings where immediate use, time after time, of a beverage chiller was needed.

U.S. Pat. No. 1,731,539 issued to Pearson discloses a milk chilling device where as ice melts, the gas escapes through a small hole or vent for the purpose of using the gas from the melting ice as a means for cooling the sides of the receptacle.

U.S. Pat. No. 2,021,368 issued to Louis discloses a beverage delivering apparatus where a cooling tube is subdivided into a plurality of individual interconnected cooling ball shaped members of such a size that a number thereof are first placed in the freezing chamber of the refrigerating machine. These hollow metallic balls are filled up to about half their volume with water which then freezes in the freezing chamber. These frozen balls were interconnected by chains and loaded into another container for use in a larger container. The major disadvantage of this complex ball type arrangement was the requirement for re-freezing which was time consuming.

U.S. Pat. No. 3,003,324 issued to Vance et al. discloses container arrangements for beverages. A large container was divided into compartments separated by heat conducting material. One of the compartments is filled with the beverage or other product while the other compartment is further divided into separate chambers containing chemicals which, when mixed, react to either produce or absorb heat and thus either heat or cool the product. This prior art technique for cooling a beverage was complex, expensive and time consuming.

U.S. Pat. No. 3,059,452 issued to Griffin discloses a cooling device for picnic jugs which uses a smaller container that has a fluid therein that, together with the smaller container, is frozen prior to use in a picnic jug. This was also impractical since refreezing of the smaller container was needed prior to use.

U.S. Pat. No. 4,091,632 issued to Marchewka et al. also disclosed a beverage cooling device that required the freezing, before use, of a semi-flexible plastic container that was used to cool the beverage. This was also impractical for commercial type needs where beverage chilling speed was required.

The present invention eliminates most of the deficiencies in the prior art and provides an improved apparatus and method to chill beverages.

SUMMARY OF THE INVENTION

In order to resolve the difficulties with melting ice cubes and with the problems in commercial establishments to rapidly chill beverages and being able to reuse the beverage chilling container immediately without diluting the beverage, it is an object of the instant invention to provide a new and improved apparatus and method for chilling beverages.

To achieve this object, the instant invention presents an article for chilling beverages without the dilution thereof which comprises a metallic container having a beveled mouth end, a handle at the mouth end for easy grasp and handling, and a hook opposite to the handle, as shown in the drawings, wherein this container is used to scoop ice and then be subsequently placed within the beverage contained in a larger container. If the ice in the smaller container holding the ice has melted before the beverage is fully consumed, the water can be discarded and a new scoop of ice obtained, thus, the beverage chiller container is ready to be used again.

BRIEF DESCRIPTION OF THE EMBODIMENT

The instant invention contemplates the use of two types of embodiments. One embodiment comprises a preferably metallic container of cylindrical shape having an attachment made of plastic with one end beveled, a handle at the lower end of the beveled end and a hook opposite to the handle, as shown in the drawings. A second embodiment comprises an entire metallic container of the same shape or configuration as the first embodiment except that it is made of one piece and the closed end of the container is preferably tapered.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
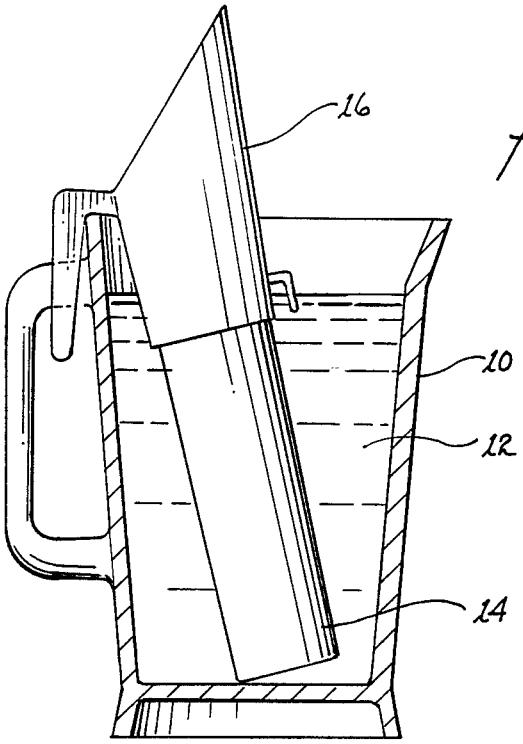
FIG. 1 is a side elevational view partly in section showing a pitcher containing a beverage with the beverage chiller of this invention hanging directly into the beverage's container by its handle.

Referring to FIG. 1, there is shown a pitcher 10 which contains a beverage 12 and a beverage chiller 14 preferably, in this embodiment, having a plastic attachment 16. The beverage chiller 14 is used for cooling the beverage 12 which can be any desired beverage.

The beverage chiller 14 comprises a metallic (preferably aluminum) cylindrical container having a closed end bottom portion and an open top end portion on which is located a preferably plastic attachment 16 that fits over the open end portion of the cylinder container 14. The beverage chiller 14 contains the chilling medium, ice, which is a phase changing medium that serves to both cool the beverage 12 and also absorb the heat from the beverage thus changing from its solid state, ice, to its liquid state, water while accomplishing the chilling of the beverage 12 in the process. Because the chilling medium, ice, is contained within the container 14 and the attachment 16 thereto, it does not mix with the beverage 12 to dilute it thus preserving the integrity of the beverage 12 while at the same time chilling the beverage 12. Once the chilling medium is melted, the beverage chiller 14 with its attachment 16 are removed from beverage container 10, the melted ice water is rapidly spilled out or discarded and new ice is scooped up or quickly and simply procured to replace the melted ice water and thus the beverage chiller 14 and its attachment 16, is ready to be used again. Because the cylinder 14 is of metallic construction, it serves as a weight allowing the cylinder 14 to sink to the bottom. Since the combined length of the container 14 and its attachment 16 extends above the top of the beverage's container 10, the chilling effect created by the beverage chiller 14 is uniform throughout the beverage 12, from top to bottom. The beverage chiller 14 with its attachment 16 that serves as a spout to facilitate discharge of the melted ice water and rapid scooping up of new ice is securely attached to the handle of the container 10 by means of its clipping handle 18. (See FIG. 3 for a view of the beverage cooler's handle 18 which depicts two portions that are biased inwardly to provide a secure grip onto the handle of the container 10).

Figure 2:
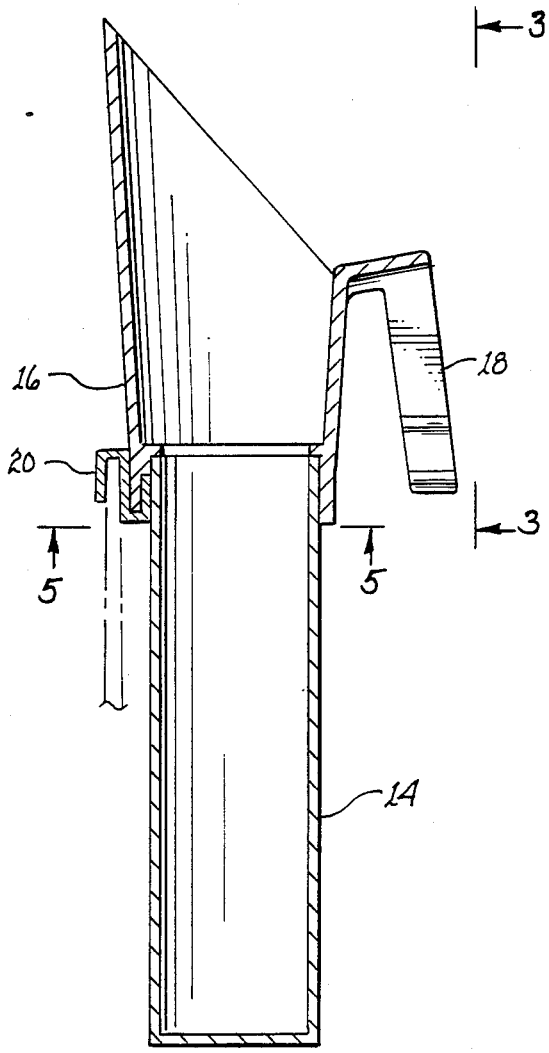
FIG. 2 is an enlarged side elevation sectional view showing the beverage chiller of FIG. 1.

Referring to FIG. 2, the beverage chiller or container 14 and its attachment 16 are assembled showing a snug fit between them. The handle 18 which is preferably, an integral part of the attachment 16, and clip 20, which is a detachable clip or hook member placed preferably opposite to the handle 18 and inbetween the outer wall of the container 14 and the lower inner wall of the attachment 16 that fits over the opening of container 14, as shown, are part of the beverage chiller apparatus. The clip or hook 20 serves to attach the empty beverage chiller 14 and its attachment 16 to an outside portion of the container 10 when not in use.

Figure 3:
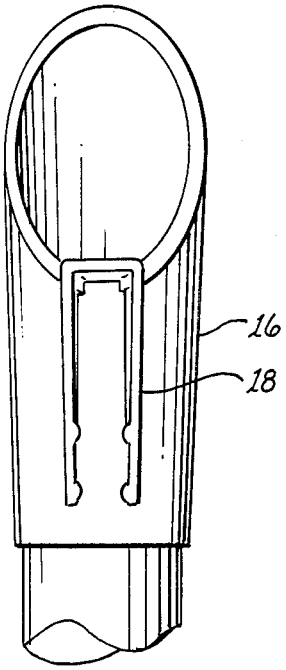
FIG. 3 is a view of the top piece of the beverage chiller of FIGS. 1 and 2 taken on the line 3—3 of FIG. 2.

Referring to FIG. 3, the beveled opening of the attachment 16 facilitates the scooping of the ice for easy handling. This figure also shows the configuration of the griping handle 18, which is attached to the container's handle, thus making it possible to pour out the beverage 12 from the container 10 with the beverage chiller 14 away from the pouring end of the container 10. Also, the beverage chiller 14 will not fall out of the container 10 while the beverage 12 is dispensed from the container 10.

Figure 4:
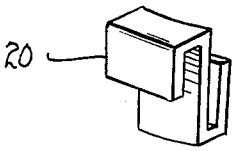
FIG. 4 is an enlarged view of the hook shown in FIG. 2.
Figure 5:
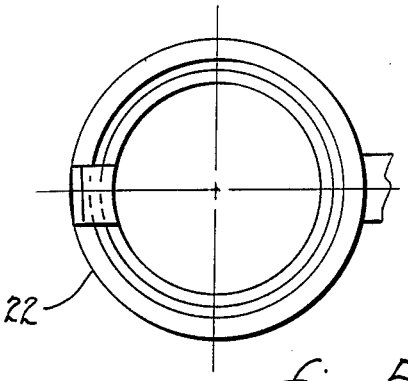
FIG. 5 is a cross-sectional view taken on the line 5—5 of FIG. 2.

Referring to FIG. 4, the clip or hook 20 is shown in an enlarged view. This hook or clip 20 facilitates vertical hanging of the beverage chiller 14 with its attachment 16 to the outside of the container 10 as well as a means for storing by attaching to some other object.

Figure 6:
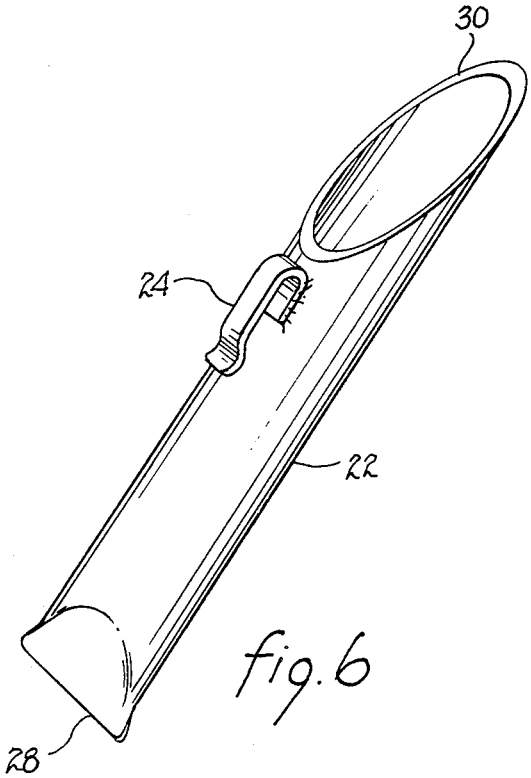
FIG. 6 is a perspective view of another embodiment of this invention.

Referring to FIG. 6, beverage chiller 22 is depicted as a single integral metallic member comprising handle 24, angled closed end 28, and beveled open end 30. This second embodiment of the the invention does not use a plastic attachment which serves to bring down the cost of the embodiment of FIG. 1.

Figure 7:
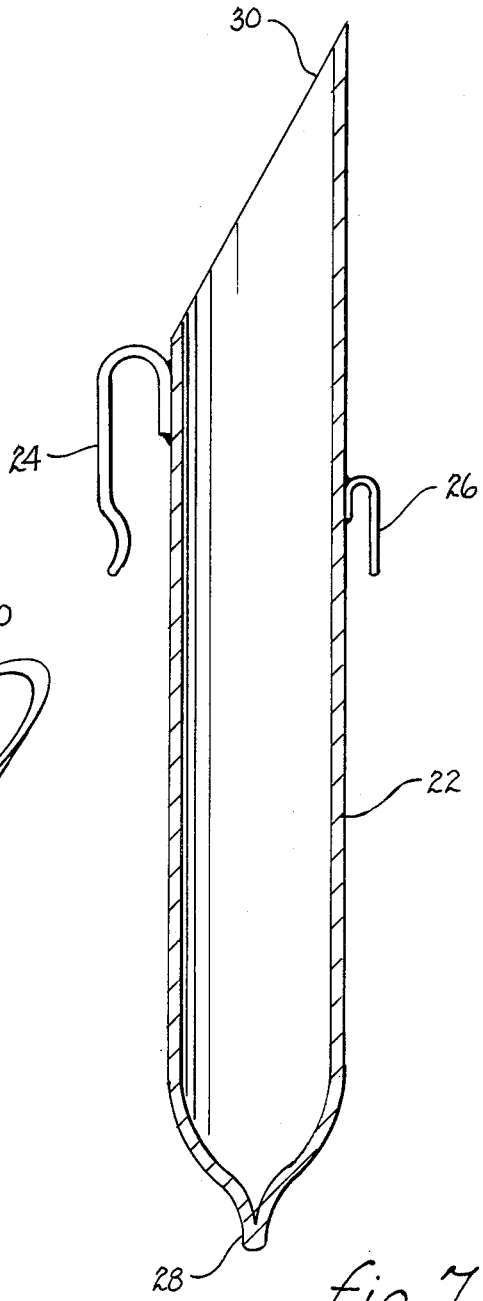
FIG. 7 is a side elevational view partly in section of the embodiment of FIG. 6.

Referring to FIG. 7, handle 24 and hook or clip 26 are respectively similar to corresponding elements 18 and 20 shown in FIG. 1 through 4, however, elements 24 and 26, are permanently or integrally attached to the beverage chiller 22. Description of the use and application of the embodiment of FIGS. 6 and 7 are the same as previously mentioned for the embodiment of FIGS. 1 through 5.

While the invention has been particularly shown and described with reference to preferred embodiments thereof, it will be understood by those skilled in the art that the foregoing and other changes in form and details may be made therein without departing from the spirit and scope of the invention.

I claim:

1. An apparatus for chilling beverages and the like, which comprises:

container means for holding ice;

handle means attached to said container means for permitting rapid attachment to and detachment of said container means to a container holing a beverage;

clipping means attached to aid handle means for firmly attaching said handle means to a handle of a container holding the beverage;

hook means located opposite to said clipping means for permitting said container means to be stored in a vertical manner;

said container means is a container cylindrical in shape;

attachment means attached to an open end portion of said container that is substantially cylindrical in shape, said attachment means is open at both ends having an open layer attachment end and an open upper beveled mouth end, said clipping means located near the bottom end of the upper beveled mouth end; and said hook means located opposite to said handle means of said attachment means for said open end portion of said container.

2. An apparatus for chilling beverages in accordance with claim 1 wherein said container means consists of metal.

3. An apparatus for chilling beverages in accordance with claim 2 wherein said metal is aluminum.

4. A method for chilling beverages and the like, which comprises:

placing ice in a container means for holding ice;

providing handle means attached to said container means for permitting rapid attachment to and detachment of said container means to a container holding a beverage;

attaching a clipping means to said handle means for firmly attaching said handle means to a handle of a container holding the beverage;

said container means is a container cylindrical in shape having an open end portion;

providing attachment means attached to said open end portion of said container that is substantially cylindrical in shape, said attachment means is open at both ends having an open lower attachment end and an open upper beveled mouth end, and said clipping means located near the bottom end of the upper beveled mouth end; and locating said hook means opposite to said handle means of said attachment means for said open end portion of said container.

5. A method for chilling beverages in accordance with claim 4 wherein said container means consists of metal.

6. A method for chilling beverages in accordance with claim 5 wherein said metal is aluminum.

7. A method according to claim 6 including attaching hook means opposite to said clipping means for permitting said container means to be stored in a vertical manner.

8. An apparatus for chilling beverages and the like, which comprises:

container means for holding ice;

handle means attached to said container means for permitting rapid attachment to and detachment of said container means to a container holding a beverage;

clipping means attached to said handle means for firmly attaching said handle means to a handle of a container holding the beverage;

said container means is a container cylindrical in shape;

attachment means attached to said open end portion of said container that is essentially cylindrical in shape, said attachment means is open at both ends having an open lower attachment end and an open upper beveled mouth end, and said clipping means located near the bottom end of the upper beveled mouth end; and hook means located opposite to said handle means of said attachment means for said open end portion of said container.

* * * * *